United States Patent [19]

Jones

[11] Patent Number: 4,586,573

[45] **Date of Patent: * May 6, 1986**

[54] ROTARY EXPANSION TOOL FOR REAMING FRUSTOCONICAL UNDERCUTS IN THE WALLS OF CYLINDRICAL HOLES

[76] Inventor: Richard H. Jones, 4439 Choctaw St., Baton Rouge, La. 70508

[ * ] Notice: The portion of the term of this patent subsequent to Mar. 5, 2002 has been disclaimed.

[21] Appl. No.: 611,344

[22] Filed: May 18, 1984

Related U.S. Application Data

[63] Continuation-in-part of Ser. No. 384,252, Jun. 2, 1982, Pat. No. 4,502,554.

[51] Int. Cl.[4] ..... E21B 7/28

[52] U.S. Cl. ..... 175/285; 175/211

[58] Field of Search ..... 175/285, 284, 286, 289, 175/329, 209, 207, 211, 406; 82/1.5; 408/159

[56] References Cited

U.S. PATENT DOCUMENTS

| | | | |
|---|---|---|---|
| 2,832,568 | 4/1958 | Kammerer, Jr. | 175/286 |
| 2,846,193 | 8/1958 | Chadderdon | 175/410 |
| 2,847,189 | 8/1958 | Shook | 175/285 |
| 2,953,362 | 9/1960 | Thassey | 175/286 X |
| 3,008,360 | 11/1961 | Winberry, Jr. | 408/159 |
| 3,127,945 | 4/1964 | Bridwell et al. | 175/329 |
| 3,220,478 | 11/1965 | Kinzback | 175/289 |
| 4,169,510 | 10/1979 | Meigs | 175/285 |
| 4,307,636 | 12/1981 | Lacey | 408/159 |
| 4,411,324 | 10/1983 | Liebig | 408/159 |

*Primary Examiner*—Stephen J. Novosad
*Assistant Examiner*—Bruce M. Kisliuk
*Attorney, Agent, or Firm*—Keaty & Keaty

[57] ABSTRACT

An improved rotary expansion tool for reaming frustoconical undercuts in the walls of cylindrical holes is disclosed. The tool is comprised of an elongated sheath with a ram disposed in sliding engagement therein. The ram is provided with an enlarged head which is biased away from the open end of the sheath into which the ram is placed. A load bearing collar is disposed around the sheath intermediate the ends for governing the depth of insertion of the tool into a hole being undercut, and the longitudinal placement of the collar along the sheath can be varied in order to select the depth to which the tool is inserted into the hole. A stop ring is circumferentially disposed around the open end of the sheath to provide a stop for limiting the longitudinal progression of the ram into the sheath, and the longitudinal placement of the stop ring can be varied in order to selectively vary the distance the ram can be pushed into the sheath against the bias of the spring. Cutter holding elements are pivotally mounted on the end of the ram opposite the enlarged head, and longitudinal advancement of the ram into the sheath against the bias of the spring expands the cutter holding elements outwardly to a pair of opposing slots through the wall of the sheath.

19 Claims, 13 Drawing Figures

ROTARY EXPANSION TOOL FOR REAMING FRUSTOCONICAL UNDERCUTS IN THE WALLS OF CYLINDRICAL HOLES

CROSS REFERENCE TO RELATED APPLICATION

This is a continuation-in-part of U.S. patent application Ser. No. 384,252 filed June 2, 1982 now U.S. Pat. No. 4,502,554, and the disclosure of that application is incorporated by reference as fully as if it appeared herein.

BACKGROUND OF THE INVENTION

Field of the Invention

The present invention relates to reaming frustoconical undercuts in cylindrical holes for placement of expansible bolts therein. More particularly, the invention relates to an improved, expansible rotary power tool for reaming frustoconical undercuts in cylindrical holes in flint and chert concrete using diamond impregnated cutters disposed on the leading edge of expandable cutter holding elements in such fashion as to maximize the surface area of the cutter being used.

GENERAL BACKGROUND

The purpose of undercutting holes is to provide a frustoconical opening within a cylindrical hole for placement of an expansible anchor bolt. Such an undercut is particularly useful in securing bolts in an existing concrete, stone or other masonry structure where the hole is drilled after the structure is built, as distinguished from a wall having bolts embedded therein before the concrete sets.

The undercutting of the hole helps prevent dislodgement of the anchor bolt, especially as compared with an anchor bolt set into a hole having only cylindrical walls and relying on friction to prevent withdrawal of the bolt after it has been expanded. The superior reliability of an anchor bolt placed in an undercut hole accounts for its extensive use in such "failsafe" structures as nuclear reactor containment facilities.

A very early attempt to provide a reamer having sufficient stability and accuracy to adequately undercut the walls of a hole is disclosed in U.S. Pat. No. 1,710,580 issued to LeBus. The reamer comprised a tubular body having an internal sleeve which advanced downwardly against an upwardly curving cutter blade to force the blades downwardly into a horizontal cutting position.

U.S. Pat. Nos. 1,824,238, 2,060,352, 2,216,895, 2,872,160, 2,997,119, 4,091,882 and 3,365,010 also concern cutting tools having expansible cutter holding blades.

The flaws of the prior art are perhaps most dramatically illustrated by U.S. Pat. No. 4,307,636 issued to Lacey. The '636 patent discloses a drilling tool superficially similar to the tool of the present invention, but without providing means for introducing cooling and circulating fluid through the ram to the vicinity of the cutters. The Lacey patent also failed to disclose a cutter mounted on the cutter holder in such a way that the cutting face of the cutter was substantially tangential to the wall of the hole being cut. The Lacey tool also lacked an ability to adjust the depth to which the tool was inserted into the hole being undercut, and also lacked means for adjusting the degree to which to the cutters were expanded so that the diameter of the frustoconical holes being cut could be varied.

It is accordingly an object of this invention to provide an undercutting tool which is capable of cutting very dense types of concrete, such as those containing flint and chert.

It is another object of this invention to provide a versatile cutting tool in which the depth of insertion of the tool into the hole can be variably controlled, and in which the degree of expansion of the cutters can also be precisely varied.

Another object of the invention is to provide a tool in which cuttings are flushed out of the hole and the blades are cooled by a stream of fluid introduced into the hole through the tool.

It is still another object of the present invention to orient the cutters on the cutter holding elements in such a way that the cutting face of the cutter is substantially tangential to the hole being undercut, thereby utilizing a greater surface area of the cutter element.

SUMMARY OF THE INVENTION

The foregoing objects have been achieved by providing a rotary expansion tool for reaming frustoconical undercuts in the wall of a cylindrical hole and flushing cuttings out of the hole as the reaming process is occurring. The tool is comprised of an elongated sheath having an open end and an opposing end for insertion into the hole being undercut. First and second longitudinal opposing slots are provided through the wall of the sheath adjacent the end of the sheath inserted into the hole. A ram is slidingly disposed within the sheath with a first end of the ram projecting out of the open end of the sheath and the second end of the ram forming a clevis for placement in the interior of said sheath adjacent said opposing slots. The first end of the ram is provided with an enlarged head, and a longitudinal passageway extends the length of the ram by which fluid introduced through an orifice in the enlarged head can be conveyed to the second end of the ram to cool the cutters and flush away cuttings.

A spring is disposed around the ram between the open end of the sheath and the enlarged head of the ram for biasing the head away from the open end of the sheath.

A load bearing collar is disposed around the sheath for governing the depth of insertion of the tool into the hole, and a bearing assembly is circumferentially disposed around the sheath between the sheath and collar for permitting the collar to remain stationary while the sheath rotates. The longitudinal placement of the collar along the sheath is selectively variable in order to vary the depth to which the tool is inserted into the hole. A plurality of u-shaped openings in the collar permit fluid introduced through the ram to flow out of the hole and to the exterior of the collar.

First and second opposing, elongated, substantially identical cutter holding elements are pivotally supported in back to back relationship by a clevis pin mounted in the clevis of the ram, and a pivot pin transfixes the cutter holding elements and the sheath below the clevis pin. By mounting the cutter holding elements in this fashion, the longitudinal advancement of the ram into the sheath against the bias of the spring pivots the cutter holding elements around the pivot pin and expands them through the opposing longitudinal slots.

A cutter is mounted on each of the cutter holding elements, and the cutter is provided with a substantially flat cutting face which is disposed in reaming engagement with the walls of the hole to ream a frustoconical undercut when the cutter holding elements are expanded. The cutter is mounted on the cutter holding element so that the plane of the cutting face is substantially tangential to the wall of the hole being reamed as the reaming process occurs. The cutting face is comprised of a substrate impregnated with diamonds, the concentration of diamonds in the substrate being greater on those portions of the cutting face which ream the larger diameter portion of the frustoconical hole. In preferred embodiments, the cutter is removably mounted on the cutter holding element to provide for easy replacement of worn cutter blades.

DETAILED DESCRIPTION OF THE PREFERRED EMBODIMENTS

Figure 1:
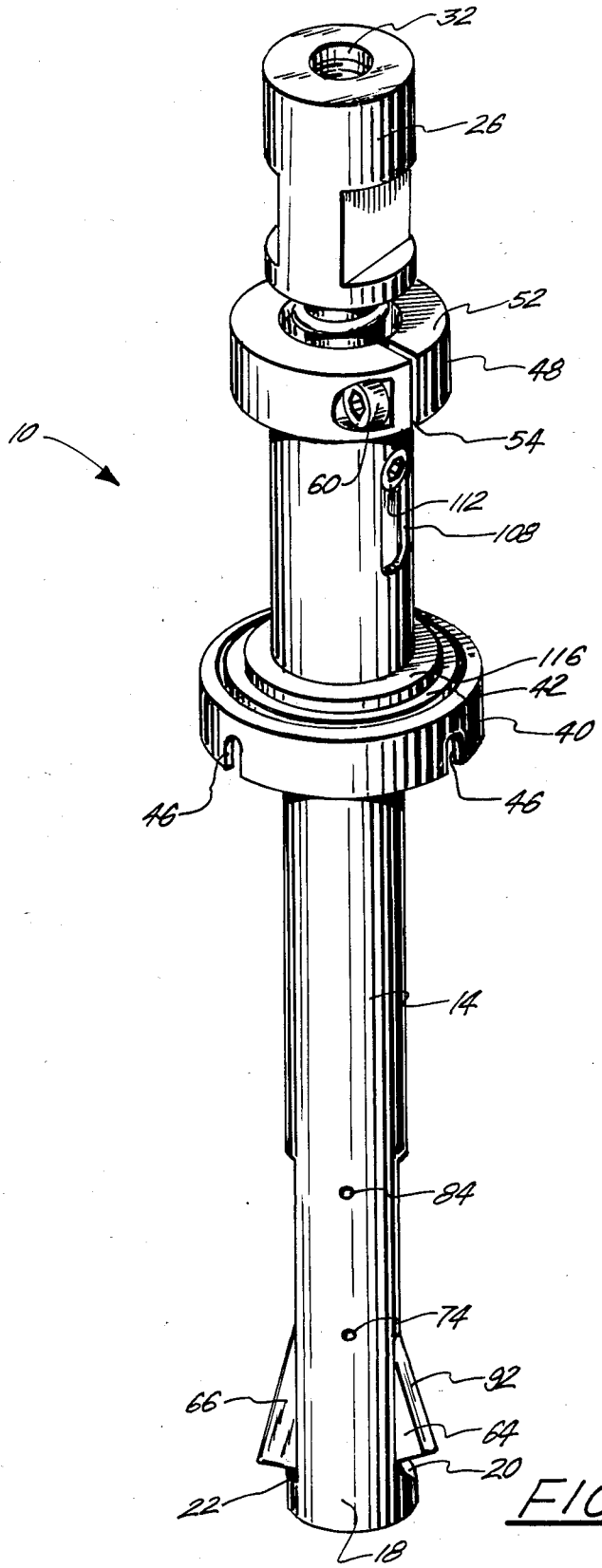
FIG. 1 is a perspective view of the rotary expansion tool of the present invention.
Figure 2:
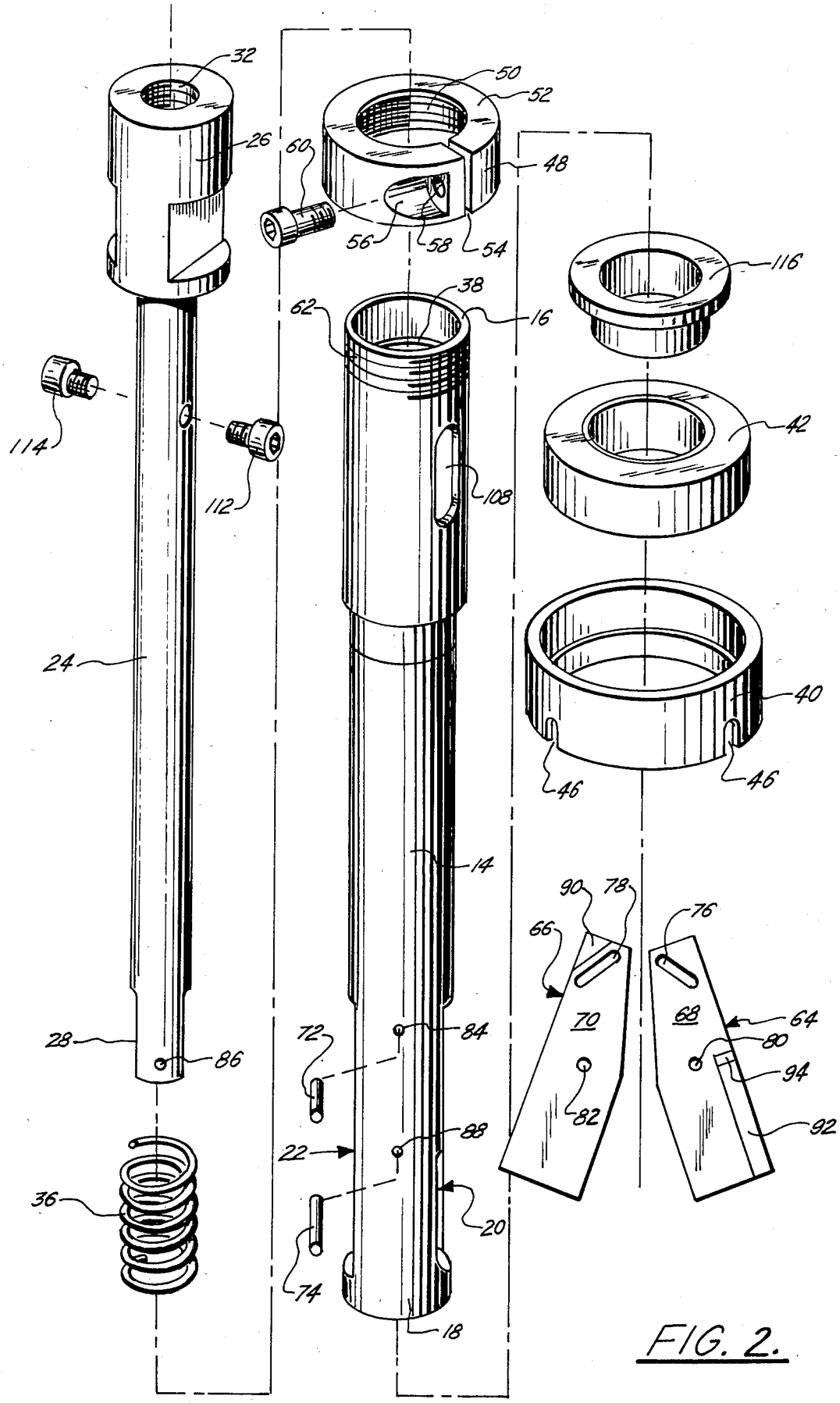
FIG. 2 is an exploded view of the tool shown in FIG. 1, the parts of the tool being disassembled.
Figure 3:
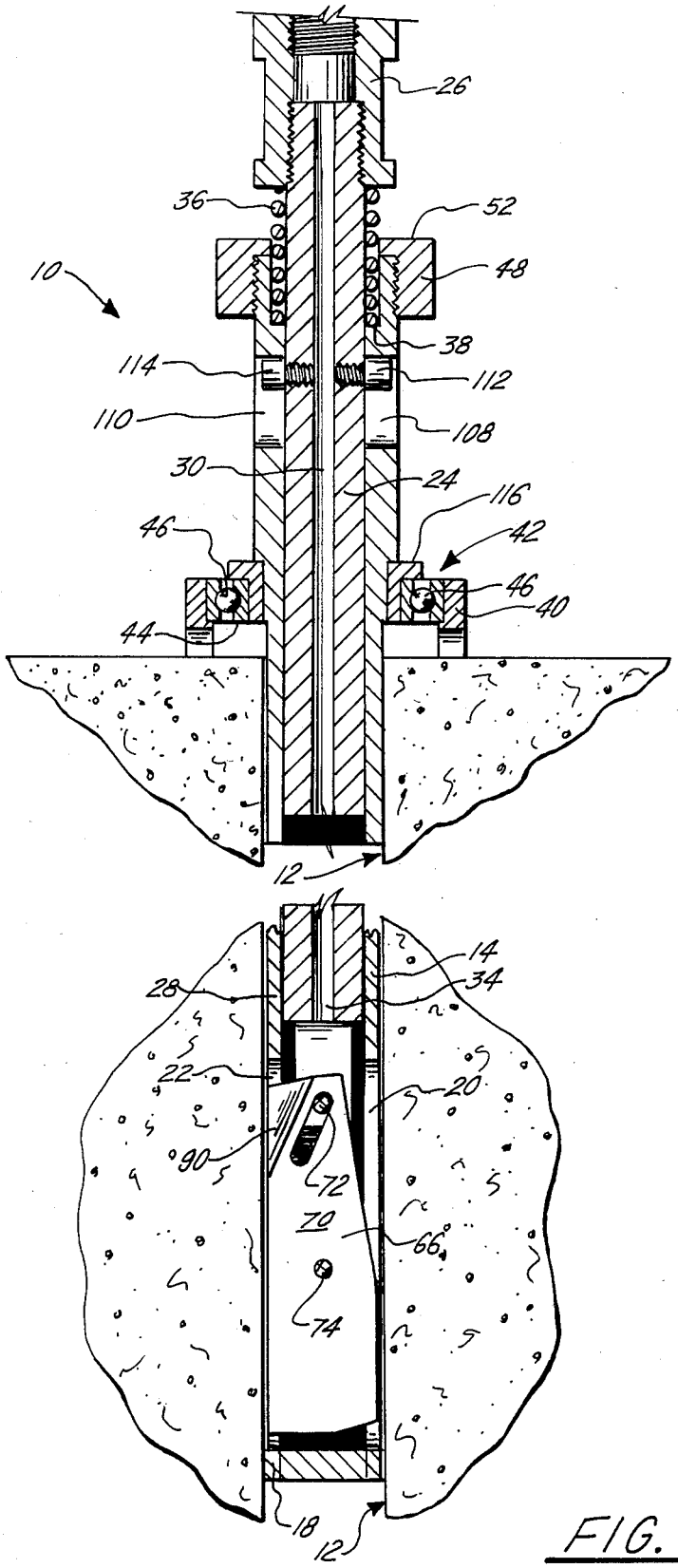
FIG. 3 is a fragmentary, cross-section of the assembled tool shown in FIG. 1, the tool being disposed in a cylindrical hole which is to be undercut, the back face of one of the cutter holding elements being shown.

A rotary expansion tool 10 for reaming frustoconical undercuts in the wall 12 of a cylindrical hole is shown in the drawings. An elongated sheath 14 has an open end 16 and an end 18 for insertion into the cylindrical hole (see FIG. 2). Sheath 14 is also provided with first and second opposing, longitudinal slots 20, 22 through the wall of sheath 14 intermediate ends 16, 18 and adjacent end 18.

An elongated, tubular ram 24 is disposed in sliding engagement within sheath 14, a first end of ram 24 projecting out of open end 16 of sheath 14 and being provided with an enlarged head 26. A second end of ram 24 forms a clevis 28 for placement adjacent opposing slots 20, 22 in the interior of sheath 14. A longitudinal passageway 30 extends the length of ram 24 and communicates with the exterior of ram 24 through an orifice 32 in head 26 and an orifice 34 adjacent clevis 28. Passageway 30 provides a means through which fluid introduced through orifice 32 in head 26 can be conveyed the length of ram 24 to the second end of ram 24 adjacent clevis 28.

A biasing means is provided between open end 16 of sheath 14 and enlarged head 26 of ram 24 for biasing enlarged head 26 away from open end 16 of sheath 14. The biasing means is, in preferred embodiments, comprised of a spring 36 which rests on a shoulder 38 on the interior of sheath 14. Shoulder 38 is formed by enlarging the inner diameter of sheath 14 adjacent open end 16 of sheath 14. The outer diameter of spring 36 is substantially the same as the inner diameter of the enlarged portion of sheath 14, while the inner diameter of the remainder of sheath 14 is smaller than the outer diameter of spring 36. The spring accordingly seats securely on shoulder 38, and is disposed in circumferential engagement around ram 24 when ram 24 is in place within sheath 14. The outer diameter of enlarged head 26 is greater than the outer diameter of spring 36, so spring 36 biases enlarged head 26 of ram 24 away from open end 16 of sheath 14.

A load bearing collar 40 is disposed around sheath 14 intermediate ends 16, 18 for governing the depth of insertion of tool 10 into the hole being undercut. A bearing assembly 42 is circumferentially disposed around sheath 14 between sheath 14 and collar 40 for permitting collar 40 to remain stationary while sheath 14 rotates. Bearing assembly 42 is comprised of a race 44 and ball bearings 46 within race 44. Collar 40 is provided with a plurality of substantially U-shaped openings 46 for permitting fluid introduced into the hole through passageway 30 in ram 24 to flow out of the hole under collar 40 and to the exterior of collar 40 through U-shaped openings 46, thereby flushing cuttings out of the hole.

A stop ring 48 is annularly disposed around sheath 14 adjacent open end 16 for providing a stop against the longitudinal sliding of ram 24 into sheath 14 against the bias of spring 36. Stop ring 48 is provided with internal threads 50, upper face 52, and transverse separation 54. A screw receiving indentation 56 houses an internally threaded opening 58. A corresponding internally threaded opening is disposed in the opposing face of transverse separation 54, but is not shown in the drawings. Screw 60 fits into indentation 56 and threads through the internally threaded openings in the faces of transverse separation 54 in order to tighten or loosen stop ring 48 from engagement with external threads 62 on sheath 14. A portion of stop ring 48 substantially encloses an area between open end 16 of sheath 14 and enlarged head 26, i.e., stop ring 48 in effect extends the length of sheath 14 so as to provide an upper face 52 having a variable location against which enlarged head 26 is stopped in its longitudinal advancement into sheath 14. The selective variation of the longitudinal placement of stop ring 48 along sheath 14 controls the degree of expansion of cutter holding elements described below.

First and second opposing, elongated, substantially identical cutter holding elements 64, 66 are provided. Each element 64, 66 has a front face 68 and a back face 70. Cutter holding elements 64, 66 are pivotally supported in back to back relationship by a clevis pin 72 mounted in clevis 28 and a pivot pin 74 transfixing cutter holding elements 64, 66 and sheath 14. Clevis pin 72 is mounted through cutter holding elements 64, 66 by placement through diagonol slots 76,78 in cutter holding elements 64, 66 respectively. The diagonal slots are identically placed through each of cutter holding elements 64, 66 and run from a position close to the cutter (described below) on the side of the cutter holding element on which the cutter is mounted to a position on the opposite side of the cutter holding element, and longitudinally displaced along cutter holding element away from the cutter towards the central axis of ram 24. Pivot pin 74 is of a greater length than clevis pin 72, and pivot pin 74 thereby transfixes sheath 14 and cutter holding elements 64, 66 when it is placed through clevis pin receiving apertures 80, 82. Since clevis pin 72 is of a length shorter than the inner diameter of sheath 14, clevis pin 72 is merely carried within clevis 28 without usually transfixing sheath 14. An aperture 84 is provided in the sheath through which clevis pin 72 can be introduced into aperture 86 in clevis 28, but that is the only function of aperture 84. Since pivot pin 74 is, however, of a length greater than the inner diameter of sheath 14, pin 74 is carried within aperture 88 and transfixes sheath 14 through clevis pin apertures 80, 82 in cutter holding elements 64, 66.

Each of said cutter holding elements, 64, 66 is provided with a recess 90 in the back face 70 thereof adjacent clevis pin 72. The recesses 90 on the back of each cutter holding element 64, 66 cooperatively form a channel through which water introduced through passageway 30 is directed away from its longitudinal pathway through ram 24 and towards the cutters mounted on cutter holding elements 64, 66. The presence of this channel more effectively conveys fluid to the cutters themselves, thereby cooling them and flushing away any cutting debris.

Figure 5:
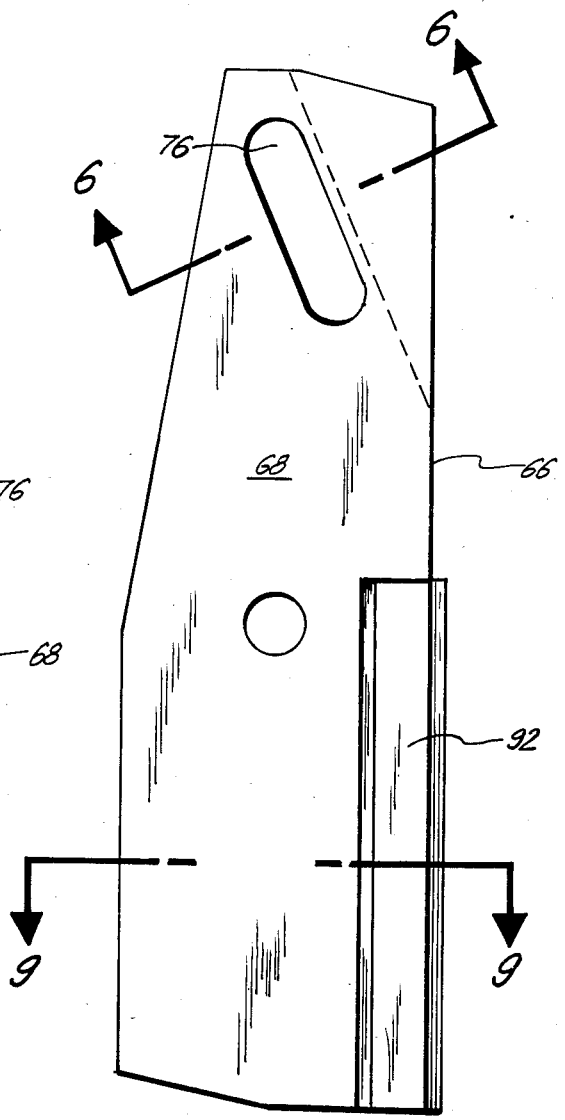
FIG. 5 is an enlarged, front view of the cutter holding element shown in FIG. 4.
Figure 9:
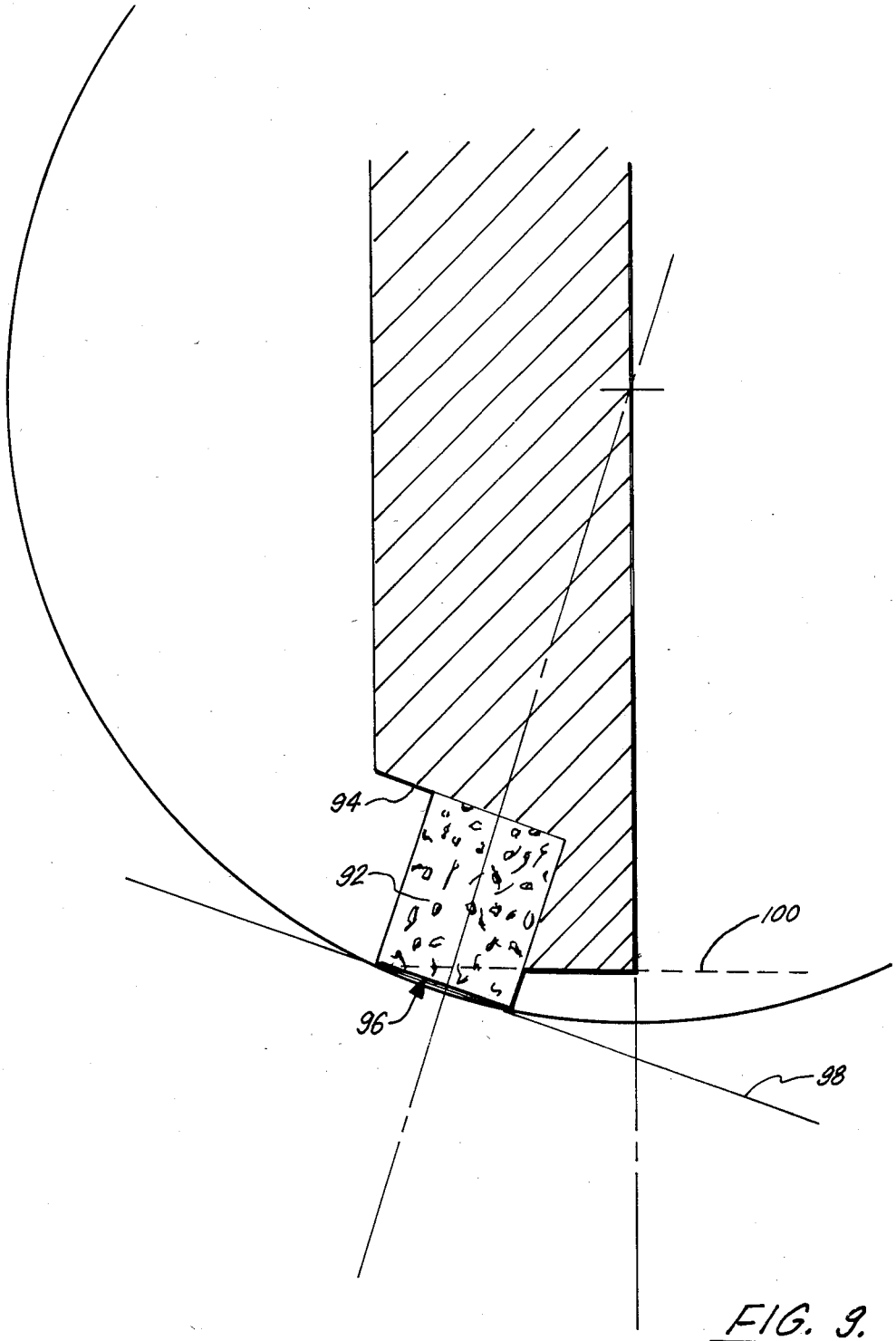
FIG. 9 is an enlarged cross-sectional view taken along section lines 9—9 in FIG. 5, the tangential relationship of the cutting face to the walls of the hole during the undercutting process being shown.

A cutter 92 (see especially FIGS. 5 and 9) is mounted in a longitudinal recess 94 on each of said cutter holding elements 64, 66. Cutter 92 has a substantially flat cutting face 96 which is disposed in reaming engagement with the walls of the hole being undercut to ream a frustoconical undercut when cutter holding elements 64, 66 are expanded. Cutting face 96, and its tangential relationship to the wall of the hole being undercut is best seen in FIG. 9. Cutter 92 is mounted on each of cutter holding elements 64, 66 so that the plane of cutting face 96 is substantially tangential to the wall of the hole being reamed as the reaming process occurs. This substantially tangential relationship between cutting face 96 and the walls can usually be achieved by mounting cutter 92 in recess 94 in such a way that the plane of cutting face 96 (schematically shown as line 98 in FIG. 9) is at an angle of 2° to 22° with the plane 100 (a broken line in FIG. 9) coincident with the bottom face of the cutter holding element.

Figure 13:
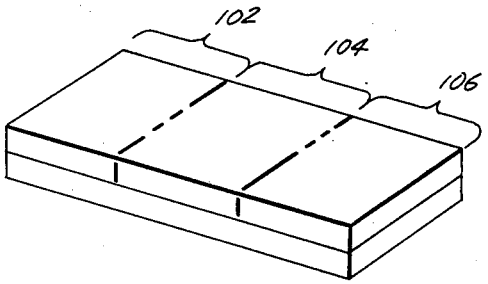
FIG. 13 is an enlarged, schematic view of the cutter, the three regions of the cutter face being shown in phantom, each of these regions having a different concentration of diamonds impregnated in the matrix of the cutter.

Cutting face 96 is comprised of a substrate impregnated with synthetic diamonds, the ratio of diamond to substrate being greater on those portions of cutting face 96 which ream the larger diameter portion of the frustoconical hole. As best schematically seen in FIG. 13, cutting face 96 is comprised of first, second and third regions 102, 104, 106. First region 102 is the portion of cutting face 96 which is most adjacent clevis pin 72 and which reams the smallest diameter portion of the frustoconical hole. Third square region 106 is the portion of cutting face 96 which is most distant from clevis pin 92 and which reams the largest diameter portion of the frustoconical hole.

Second region 104 is intermediate first and third regions 102, 106, and region 104 reams the intermediate diameter portions of the frustoconical hole. In preferred embodiments, the matrix of region 106 is impregnated with a concentration of diamonds which substantially saturates the matrix with impregnated diamonds. The matrix of second region 104 is impregnated with a concentration of diamonds which is about one-half as concentrated as region 106, and the matrix of region 102 is impregnated with diamonds to a concentration about one-half the concentration of diamonds in region 104. This arrangement provides more diamonds in those regions of cutting face 96 which cut the larger diameter portions of the frustoconical hole, thereby providing more effective cutting in those regions of the cutting face where the more effective cutting is required.

First and second opposing limit slots 108, 110 are provided through sheath 14 intermediate collar 40 and open end 16 of sheath 14. A first limit pin 112 is carried by ram 24 and projects into first limit slot 108. A second limit pin 114 is carried on the opposite side of ram 24 and projects into second limit slot 110. First and second limit pins 112, 114 cooperatively transmit rotational movement of ram 24 to sheath 14 without obstructing passageway 30 through ram 24.

Collar 40 seats against an annular retainer 116 around sheath 14 for preventing longitudinal displacement of load bearing collar 40 towards open end 16 of sheath 14. The outer diameter of sheath 14 above retainer 116 is greater than the outer diameter of the remainder of sheath 14. Retainer 116 has an inner diameter less than the outer diameter of sheath 14 above retainer 116, and retainer 116 thereby seats against the enlarged diameter portion of sheath 14 to prevent longitudinal displacement of retainer 116 and collar 40 towards open end 16 of sheath 14.

Figure 7:
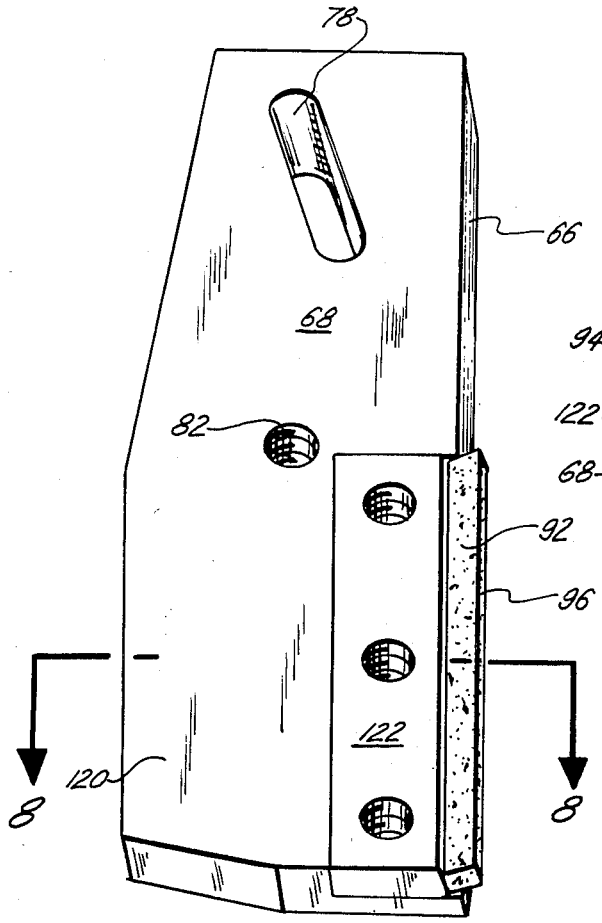
FIG. 7 is a perspective view of a second embodiment of the blade shown in FIG. 5, the orientation of the cutting face of the cutter being shown.
Figure 8:
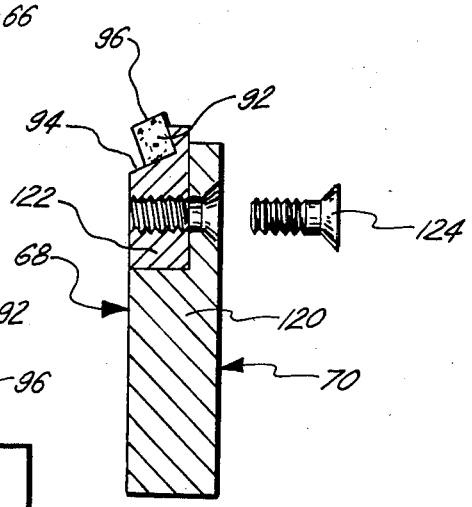
FIG. 8 is a view taken along section lines 8—8 in FIG. 7.

In a second embodiment of cutter holding elements 64, 66, which is shown in FIGS. 7 and 8, cutter holding elements 64, 66 are comprised of a base 120 and selectively removable insert 122. Insert 122 is selectively secured to base 120 with a plurality of screws 124 which are fixed through internally threaded openings which are cooperatively aligned in base 120 and insert 122. When it is desired to replace cutter 92 in such an embodiment, screws 124 are removed from their internally threaded openings and insert 122 is separated from base 120. A new insert 122 bearing a cutter 92 (which is disposed at the appropriate angle to provide for a tangential relationship between the cutting face and the wall of the hole) is then attached by threading screws 124 through the aligned openings in base 120 and insert 122.

In the embodiment of tool 10 shown in FIGS. 1–5, and as especially seen in FIG. 9, cutter 92 is silver soldered into recess 94. Silver soldering of cutter 92 solidly secures cutter 92 to its cutter holding element. When and if it is desired to remove cutter 92 from its cutter holding element, the blade can merely be reheated to melt the silver solder and remove cutter 92, which can then be replaced with a new cutter.

Figure 11:
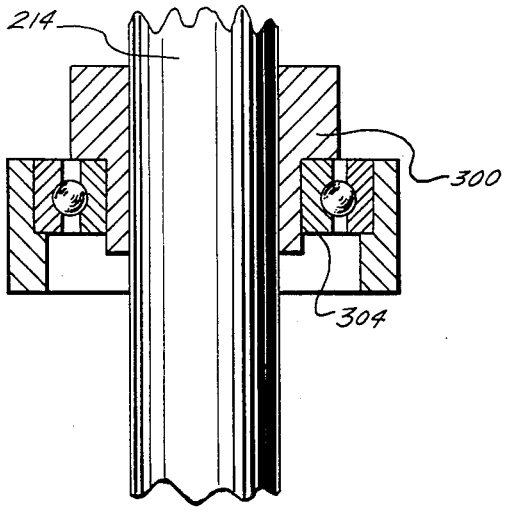
FIG. 11 is a cross-sectional view taken along section line 11—11 in FIG. 10.
Figure 12:
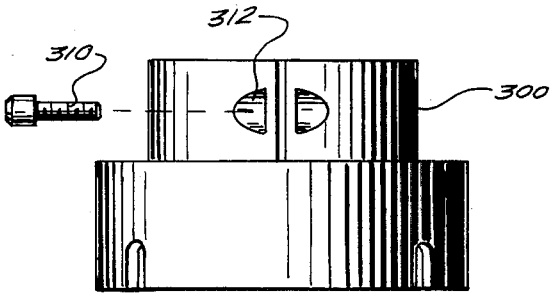
FIG. 12 is a side view of the load bearing collar showing the means for selectively varying longitudinal displacement of the collar along the sheath.
Figure 10:
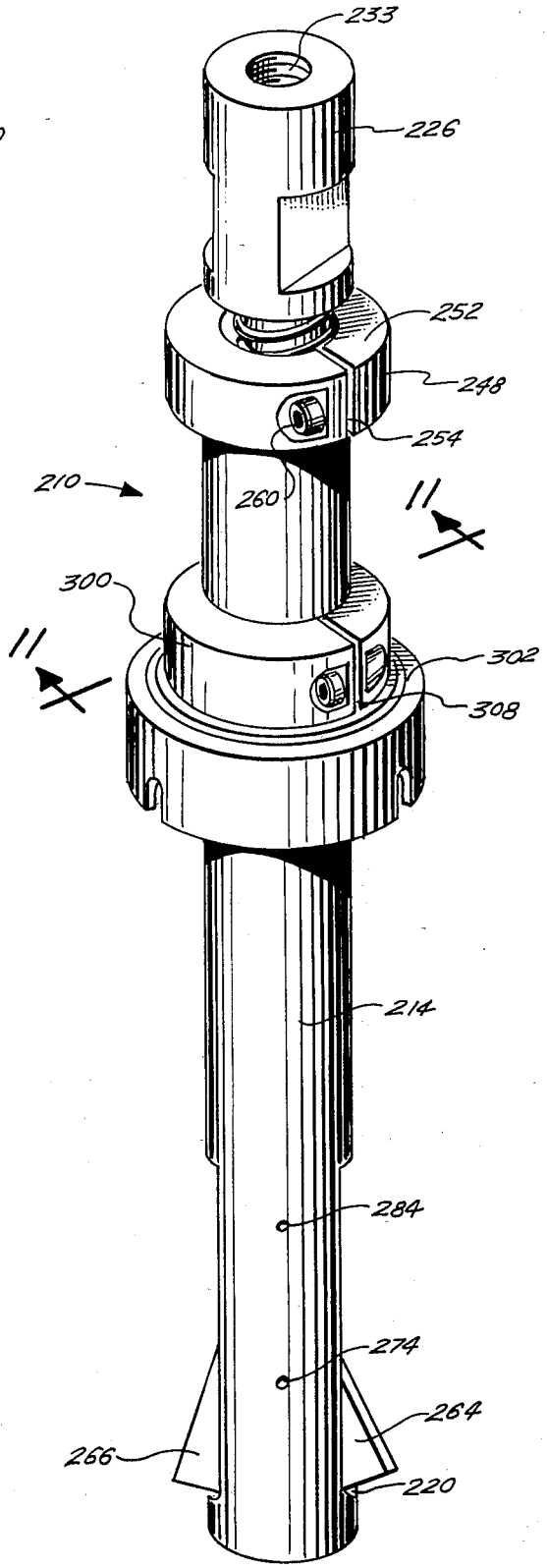
FIG. 10 is a perspective view of another embodiment of the present tool, the longitudinal placement of the load bearing collar along the sheath being selectively variable to provide for variation in the depth of insertion of the tool into the hole being undercut.

In yet another embodiment of the tool, which is shown in FIGS. 10–12, the longitudinal placement of the load bearing collar on the sheath can be selectively varied to provide means for varying the depth of insertion of tool 10 into the hole being undercut. The tool shown in FIGS. 10–12 is substantially the same as that shown in the other figures, so corresponding parts are referred to with the same reference numerals plus 200, with the exception of those parts which are different from those shown in FIGS. 1–9, and those parts are referred to with numerals beginning with 300.

A load bearing collar 301 is provided with a bearing assembly 302 which permits collar 300 to remain stationary while sheath 214 rotates. Bearing assembly 302 is comprised of a race 304 and bearing 306. A collar retainer 300 holds collar 301 in place, retainer 300 being divided by a transverse separation 308 which is held together with a screw 310 which is placed in an indentation 312 in the exterior of collar 300. When screw 310 is loosened, the faces of separation 308 move relatively far apart from one another and collar retainer 300 can be longitudinally moved along sheath 214 until it is placed at a desired position. Screws 310 is then tightened to bring the faces of separation 308 close together and tighten collar 300 to sheath 214. Collar retainer 300 will then maaintain collar 301 at its desired longitudinal position on sheath 214.

In operation, tool 14 is inserted into a cylindrical hole so that collar 40 rests against the surface of the wall which surrounds the hole. Enlarged head 26 is attached to a manifold (not shown) which rotates ram 24 while simultaneously longitudinally pressing ram 24 into sheath 14 against the bias of spring 36. Water is also introduced simultaneously through orifice 32 in enlarged head 26. The longitudinal progression of ram 24 into sheath 14 continues until head 26 comes into abuttment with upper face 52 of stop ring 48.

The rotational motion of ram 24 is imparted to sheath 14 through limit pins 112, 114 and pivot pin 74. Collar 40, however, remains in stationary abuttment with the wall because bearing assembly 42 permits sheath 14 to rotate independently of collar 40.

Figure 4:
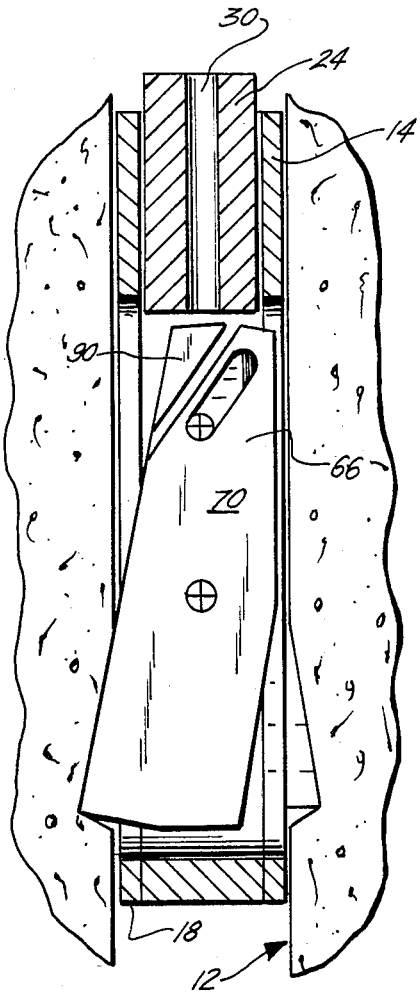
FIG. 4 is a view of the cutter holding element shown in FIG. 3, the cutter holding element having been pivoted about a pivot pin to expand it into reaming engagement with the wall of the cylindrical hole.
Figure 6:
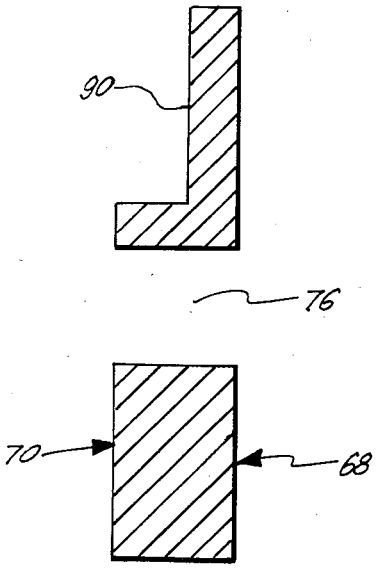
FIG. 6 is a view taken along section lines 6—6 in FIG. 5.

The inward progression of ram 24 into sheath 14 pushes clevis pin 72 downwardly through diagonol slots 76, 78. Since diagonol slots 76, 78 are diagonol in different directions, the forward advancement of clevis pin 72 through the slots pivots cutter holding elements 64, 66 around pivot pin 74 and advances cutter holding element 64 through slot 20 and cutter holding element 66 through slot 22. The expansion of the cutter holding elements beings cutting face 96 of cutter 92 into cutting engagement with the walls of hole, and begins to ream a frustoconical undercut (as seen in FIG. 4).

The water being introduced through passageway 30 meanwhile flows out of ram 24 adjacent clevis 28 and is thence directed by each of recesses 90 away from its longitudinal progression and towards the cutters 92, which are thereby cooled. Any cuttings or other debris are also flushed away by the water, and they move upwardly through the hole and escape under collar 40 and through U-shaped openings 46.

If it is desired to vary the amount of expansion of cutter holding elements 64, 66, then screw 60 is loosened so that the opposing faces of transverse separation 54 move apart and stop ring 48 is loosened. The longitudinal placement of stop ring 48 determines how far ram 24 can advance into sheath 14 before being stopped, and this stopping position determines the maximum expansion of cutter holding elements 64, 66. In this fashion, the maximum diameter of the frustoconical hole being reamed can be precisely varied.

In the embodiment of the invention shown in FIGS. 10–12, the longitudinal placement of the collar along the sheath can be varied in a fashion similar to the manner in which the placement of the stop ring is varied. Screw 310 is loosened so that collar 300 moves out of frictional engagement with sheath 214. Collar 300 is then moved to a desired position so that tool 210 will be inserted to a desired depth in the cylindrical hole being undercut.

Impregnation of cutting face 96 of cutter 92 with diamonds results in a superior cutting surface that is useful in undercutting cylindrical holes even in such dense materials as flint and chert concrete. A higher concentration of diamonds in those areas of cutting face 96 which ream the larger diameter portions of the frustoconical undercut provides greater cutting efficiency and a longer life for the cutter 92. Since cutter 92 is removable from the cutter mounting element, worn cutters can be easily replaced by melting the silver solder around the cutter, removing the worn cutter, and replacing it with a new one. In alternate embodiments, cutter 92 is secured to a removable insert which can be removably secured to the cutter element base with fasteners such as screws.

I claim:

1. A rotary expansion tool for reaming frustoconical undercuts in the wall of a cylindrical hole and flushing cuttings out of the hole as the reaming process is occurring, said tool comprising:

an elongated sheath having an open end and an end for insertion into said hole, and first and second longitudinal opposing slots through the wall of said sheath intermediate said ends;

a ram disposed in sliding engagement within said sheath, a first end of said ram projecting out of said open end of said sheath and being provided with an enlarged head, a second end of said ram forming a clevis for placement in the interior of said sheath adjacent said opposing slots of said sheath, and a longitudinal passageway extending the length of said ram by which fluid introduced through said head can be conveyed to the second end of said ram;

biasing means between the open end of said sheath and the enlarged head of said ram for biasing said head away from said open end of said sheath;

means for imparting rotational movement of said ram to said sheath;

a load bearing collar disposed around said sheath intermediate said ends of said sheath for governing the depth of insertion of said tool into said hole, and a bearing assembly circumferentially disposed around said sheath between said sheath and collar for permitting said collar to remain stationary while said sheath rotates;

first and second opposing, elongated, substantially identical cutter holding elements, each cutter holding element having a front face and a back face, said cutter holding elements being pivotally supported in back to back relationship by a clevis pin mounted in said clevis, and a pivot pin transfixing said first and second cutter holding elements and said sheath;

means for pivoting said cutter holding elements around said pivot pin to expand said elements through said slots, said first cutter holding element expanding through said first slot and said second cutter holding element expanding through said second slot;

a cutter on each of said cutter holding elements, said cutter having a substantially flat cutting face which is disposed in reaming engagement with the walls of said hole to ream a frustoconical undercut when said cutter holding elements are expanded, said cutter being mounted on said cutter holding element so that the plane of said cutting face is substantially tangential to the wall of said hole being reamed as the reaming process occurs.

2. The tool of claim 1, wherein said collar is provided with a plurality of openings for permitting fluid introduced into said hole through said passageway in said ram to flow out of said hole under said collar and to the exterior of said collar through said openings, thereby flushing said cuttings out of said hole.

3. The tool of claim 2, wherein said cutting face is comprised of a substrate impregnated with diamonds, the ratio of diamonds to substrate being greater on those portions of said cutting face which ream the larger diameter portion of said frustoconical hole.

4. The tool of claim 3, wherein said cutting face is comprised of first, second and third regions, said first region being the portion of said face which is most adjacent said clevis pin and which reams the smallest diameter portion of said frustoconical hole, said third region being the portion of said face which is most distant said clevis pin and which reams the largest diameter portion of said frustoconical hole, said second region being intermediate said first and third regions of said face and which reams the intermediate diameter portions of said frustoconical hole, a matrix of said third region being impregnated with a concentration of diamonds which substantially saturates said matrix with impregnated diamonds, said matrix of said second region being impregnated with a concentration of diamonds which is about one-half as concentrated as said third region and said matrix of said first region being impregnated with diamonds to a concentration about one-half the concentration of said second region.

5. The tool of claim 4, wherein said first, second and third regions have substantially equal areas.

6. The tool of claim 5, wherein said front face of said cutter element is provided with a recess in which said cutter is removably mounted.

7. The tool of claim 6, wherein said cutter is soldered in said recess.

8. The tool of claim 5, wherein said front face of said cutter element is provided with a recess in which said cutter is mounted, said cutter holding element being comprised of a base and a selectively removable insert, said cutter being mounted on said selectively removable insert.

9. The tool of claim 3, wherein said load bearing collar seats against an annular retainer around said sheath for preventing longitudinal displacement of said load bearing collar towards said open end of said sheath.

10. The tool of claim 9, wherein the outer diameter of said sheath above said annular retainer is greater than the outer diameter of the remainder of said sheath, said annular retainer having an inner diameter less than the outer diameter of said sheath above said retainer, said annular retainer thereby seating against said enlarged diameter portion of said sheath to prevent longitudinal displacement of said annular retainer and load bearing collar towards said open end of said sheath.

11. The tool of claim 3, wherein said load bearing collar is provided with means for selectively varying the longitudinal placement of said load bearing collar on said sheath, thereby providing means for selectively varying the depth of insertion of said tool into said hole.

12. The tool of claim 3, wherein the inner diameter of said sheath at its open end is less than the outer diameter of the portion of said enlarged head adjacent said open end of said sheath, said sheath thereby providing a stop against the longitudinal sliding of said ram into said sheath against the bias of said biasing means.

13. The tool of claim 3, wherein a stop ring is annularly disposed around said sheath adjacent said open end for providing a stop against the longitudinal sliding of said ram into said sheath against the bias of said biasing means, a portion of said stop ring substantially enclosing an area between said open end of said sheath and said enlarged head.

14. The tool of claim 13, wherein the longitudinal placement of said stop ring along said sheath is selectively variable for controlling the degree of expansion of said cutter holding elements.

15. The tool of claim 3, wherein said sheath is provided with first and second opposing limit slots through said sheath intermediate said load bearing collar and said open end of said sheath, a first limit pin carried by said ram and projecting into said first limit slot, and a second limit pin carried by said ram and projecting into said second limit slot, said first and second limit pins cooperatively transmitting rotational movement of said ram to said sheath without obstructing said passageway through said ram.

16. The tool of claim 3, wherein each of said first and second cutter holding elements is provided with a recess in the back wall thereof adjacent said clevis pin, the two recesses cooperatively forming a channel through which water introduced through said passageway in said ram is directed away from its longitudinal pathway and towards said cutters.

17. A rotary expansion tool for reaming frustoconical undercuts in the wall of a cylindrical hole and flushing cuttings out of the hole as the reaming process is occurring, said tool comprising:

an elongated sheath having an open end and an end for insertion into said hole, and first and second longitudinal opposing slots through the wall of said sheath intermediate said ends;

a ram disposed in sliding engagement within said sheath, a first end of said ram projecting out of said open end of said sheath and being provided with an enlarged head, a second end of said ram forming a clevis for placement adjacent said opposing slots in the interior of said sheath, and a longitudinal passageway extending the length of said ram by which fluid introduced through said head can be conveyed to the second end of said ram;

biasing means between the open end of said sheath and the enlarged head of said ram for biasing said head away from said open end of said sheath;

a load bearing collar disposed around said sheath intermediate said ends of said sheath for governing the depth of insertion of said tool into said hole, and a bearing assembly circumferentially disposed around said sheath between said sheath and collar for permitting said collar to remain stationary while said sheath rotates, said collar being provided with a plurality of openings for permitting fluid introduced into said hole through said passageway in said ram to flow out of said hole under said collar and to the exterior of said collar through said openings, thereby flushing said cuttings out of said hole;

means for selectively varying the longitudinal placement of said load bearing collar on said sheath, thereby providing means for selectively varying the depth of insertion of said tool into said hole;

a stop ring annularly disposed around said sheath adjacent said open end for providing a stop against the longitudinal sliding of said ram into said sheath against the bias of said biasing means, a portion of said stop ring substantially enclosing an area between said open end of said sheath and said enlarged head;

means for selectively varying the longitudinal placement of said stop ring along said sheath;

first and second opposing, elongated, substantially identical cutter holding elements, each cutter holding element having a front face and a back face, said cutter holding elements being pivotally supported in back to back relationship by a clevis pin mounted in said clevis, and a pivot pin transfixing said first and second cutter holding elements and said sheath, each of said first and second cutter holding elements being provided with a recess in the back face thereof adjacent said clevis pin, the two recesses cooperatively forming a channel through which water introduced through said passageway in said ram is directed away from its longitudinal pathway and towards said cutter;

means for pivoting said cutter holding elements around said pivot pin to expand said elements through said slots, said first cutter holding element expanding through said first slot and said second cutter holding element expanding through said second slot;

a cutter removably mounted in a longitudinal recess on each of said cuter holding elements, said cutter having a substantially flat cutting face which is disposed in reaming engagement with the walls of said hole to ream a frustoconical undercut when said cutter holding elements are expanded, said cutter being mounted on said cutter holding element so that the plane of said cutting face is substantially tangential to the wall of said hole being reamed as the reaming process occurs, said cutting face being comprised of a substrate impregnated with diamonds, the ratio of diamonds to substrate being greater on those portions of said cutting face which ream the larger diameter portion of said frustoconical hole; and first and second opposing limit slots through said sheath intermediate said load bearing collar and said open end of said sheath, a first limit pin carried by said ram and projecting into said first limit slot, a second limit pin carried by said ram and projecting into said second limit slot, said first and second limit pins cooperatively transmitting rotational movement of said ram to said sheath without obstructing said passageway through said ram.

18. The tool of claim 17, wherein said cutting face is comprised of first, second and third regions having substantially equal areas, said first region being the portion of said face which is most adjacent said clevis pin and which reams the smallest diameter portion of said frustoconical hole, said third region being the portion of said face which is most distant said clevis pin and which reams the largest diameter portion of said frustoconical hole, said second region being intermediate said first and third regions of said face and which reams the intermediate diameter portions of said frustoconical hole, said matrix of said third region being impregnated with a concentration of diamonds which substantially saturates said matrix with impregnated diamonds, said matrix of said second region being impregnated with a concentration of diamonds which is about one-half as concentrated as said third region, and said matrix of said first region being impregnated with diamonds to a concentration about one-half the concentration of said second region.

19. A rotary expansion tool for reaming frustoconical undercuts in the wall of a cylindrical hole and flushing cuttings out of the hole as the reaming process is occurring, said tool comprising:

an elongated sheath having an open end and an end for insertion into said hole, and first and second longitudinal opposing slots through the wall of said sheath intermediate said ends;

a ram disposed in sliding engagement within said sheath, a first end of said ram projecting out of said open end, a second end of said ram forming a clevis for placement in the interior of said sheath adjacent said opposing slots of said sheath, and a longitudinal passageway extending the length of said ram by which fluid introduced through said head can be conveyed to the second end of said ram;

biasing means for biasing said ram in a direction away from the end inserted in the hole;

means for imparting rotational movement of said ram to said sheath;

means for governing the depth of insertion of said tool into said hole;

first and second opposing, elongated, substantially identical cutter holding elements, each cutter holding element having a front face and a back face, said cutter holding elements being pivotally supported in back to back relationship by a clevis pin mounted in said clevis, and a pivot pin transfixing said first and second cutter holding elements and said sheath;

means for pivoting said cutter holding elements around said pivot pin to expand said elements through said slots, said first cutter holding element expanding through said first slot and said second cutter holding element expanding through said second slot;

a cutter on each of said cutter elements, said cutter having a cutting face which is disposed in reaming engagement with the walls of said hole to ream a frustoconical undercut when said cutter holder elements are expanded.

* * * * *